US010724157B2

(12) United States Patent
Zorn et al.

(10) Patent No.: US 10,724,157 B2
(45) Date of Patent: Jul. 28, 2020

(54) ADHESIVE TEXTILE

(71) Applicant: BAUERFEIND AG, Zeulenroda-Triebes (DE)

(72) Inventors: Wolfgang Zorn, Hohenleuben (DE); Juliane Wiedner, Auma-Weidatal (DE)

(73) Assignee: BAUERFEIND AG, Zeulenroda-Triebes (DE)

( * ) Notice: Subject to any disclaimer, the term of this patent is extended or adjusted under 35 U.S.C. 154(b) by 352 days.

(21) Appl. No.: 15/513,612

(22) PCT Filed: Sep. 10, 2015

(86) PCT No.: PCT/EP2015/070733

§ 371 (c)(1),
(2) Date: May 2, 2017

(87) PCT Pub. No.: WO2016/045985

PCT Pub. Date: Mar. 31, 2016

(65) Prior Publication Data

US 2017/0241050 A1 Aug. 24, 2017

(30) Foreign Application Priority Data

Oct. 23, 2014 (DE) ..... 10 2014 219 214

(51) Int. Cl.
*D02G 3/40* (2006.01)
*D02G 3/32* (2006.01)
(Continued)

(52) U.S. Cl.
CPC ..... *D02G 3/406* (2013.01); *D02G 3/32* (2013.01); *D03D 15/10* (2013.01); *D03D 27/00* (2013.01);
(Continued)

(58) Field of Classification Search
USPC ..... 428/357, 364, 378, 391, 394, 395; 66/185, 186; 252/8.81, 8.84; 264/211
See application file for complete search history.

(56) References Cited

U.S. PATENT DOCUMENTS 2,182,996 A 12/1939 Shepherd
4,105,569 A * 8/1978 Crossfield ..... D06M 7/00 252/8.81
(Continued)

FOREIGN PATENT DOCUMENTS

DE 1510748 A1 3/1971
GB 1077533 A 8/1967
(Continued)

OTHER PUBLICATIONS

English Translation of International Preliminary Report on Patentability and Written Opinion of the International Searching Authority regarding International Application No. PCT/EP2015/070733, dated Mar. 27, 2017. 15 pages.
(Continued)

*Primary Examiner* — Lynda Salvatore
(74) *Attorney, Agent, or Firm* — Stephen T. Olson; Harness, Dickey & Pierce, P.L.C.

(57) ABSTRACT

Textile with an adhesive effect containing at least one stitch-forming adhesive thread. The adhesive thread has a component that imparts an adhesive effect at least at a surface thereof.

16 Claims, 1 Drawing Sheet

(51) Int. Cl.

| | |
|---|---|
| ***D03D 15/10*** | (2006.01) |
| ***D04B 1/26*** | (2006.01) |
| ***D04B 1/18*** | (2006.01) |
| ***D03D 27/00*** | (2006.01) |
| ***D04B 1/14*** | (2006.01) |

(52) U.S. Cl.
CPC ..... *D04B 1/14* (2013.01); *D04B 1/18* (2013.01); *D04B 1/265* (2013.01); *D10B 2401/024* (2013.01); *D10B 2509/028* (2013.01)

(56) References Cited

U.S. PATENT DOCUMENTS

| | | | | |
|---|---|---|---|---|
| 7,748,240 | B1 * | 7/2010 | Cherneski ..... | A41B 11/008 2/239 |
| 9,345,271 | B2 | 5/2016 | Collins et al. | |
| 2007/0267084 | A1 | 11/2007 | Pereira et al. | |
| 2010/0086738 | A1 | 4/2010 | Tanaka et al. | |
| 2012/0324961 | A1 | 12/2012 | Clemendot | |
| 2014/0173808 | A1 | 6/2014 | Collins et al. | |

FOREIGN PATENT DOCUMENTS

| | | | | |
|---|---|---|---|---|
| JP | 2005-105458 | A | 4/2005 | |
| JP | 2010-285727 | A | 12/2010 | |
| JP | 2010285727 | * | 12/2010 | ..... D04B 21/18 |
| WO | WO-2011/116952 | A1 | 9/2011 | |
| WO | WO-2014/098928 | A1 | 6/2014 | |
| WO | WO-2014/174411 | A1 | 10/2014 | |

OTHER PUBLICATIONS

International Search Report (English and German) for PCT/EP2015/070733, ISA/EP, Rijswijk, NL, dated Nov. 30, 2015.
Written Opinion of the ISA for PCT/EP2015/070733, (German), ISA/EP, Rijswijk, NL, dated Nov. 30, 2015.

* cited by examiner

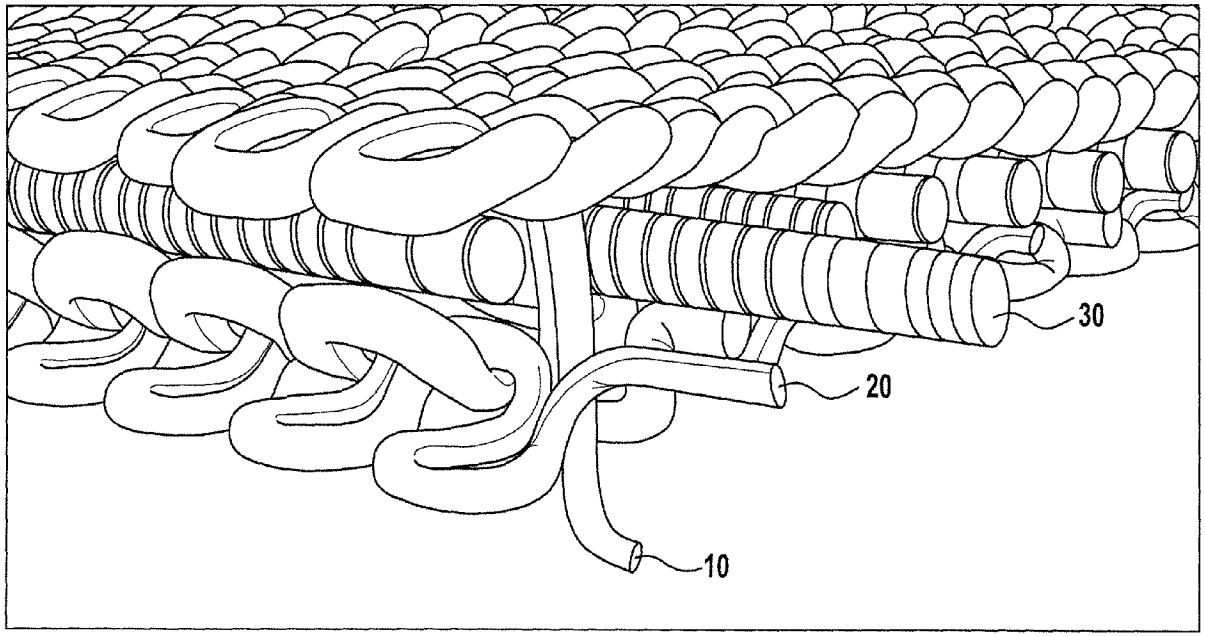
30
20
10

ADHESIVE TEXTILE

CROSS-REFERENCE TO RELATED APPLICATIONS

This application is a 371 U.S. National Stage of International Application No. PCT/EP2015/070733, filed Sep. 10, 2015, which claims the benefit of German Application No. 10 2014 219 214.5, filed on Sep. 23, 2014. The disclosures of the above applications are incorporated herein by reference.

The invention relates to a flat textile material, in particular a knit or mesh fabric, which has a surface that imparts an adhesive or self-adhesive or nonslip effect, and relates to methods and means for producing same.

There are known adhesive and self-stick materials, which are capable of producing a nonslip effect of textiles on the skin of the wearer, especially in conjunction with clothing items and medical devices, such as orthopedic bandages or phlebological compression socks. Adhesive materials include mainly elastomer materials, foremost among which are silicone elastomers (silicone rubber), polyurethane or chloroprene-based elastomers but also rubbers such as latex based on natural raw materials. These can come into intimate contact with the hairless surface of skin in particular with high friction and can prevent the textile surface of a clothing item or an orthopedic bandage or the band of a phlebological sock from slipping.

Alternative substances, which impart an adhesive effect, include self-stick adhesives, which also permit a reversible attachment to the skin surface because of their surface activity in order to prevent slipping. For example, such substances are used with such flat textile materials that do not also come in contact with the skin surface under tension because of their inherent weight or their inherent elasticity in order to produce a force-locking effect between the adhesion-imparting component and the skin surface. Fields of use of these adhesive substances in conjunction with flat textile materials include, for example, hairpieces and similar cosmetic products.

Alternative textile products that should have a high friction for the purpose of an anti-slip effect include nonslip carpets and floor coverings.

In all these products, to impart the adhesive effect, a textile product that is finished per se is additionally provided with the adhesion promoting substance, elastomer or self-stick adhesive in another processing step, in particular by application to the flat textile material. The adhesion promoting substance does not form an integral part of the flat textile material itself. It is a disadvantage in particular that the additionally applied layer of adhesion promoting component is applied to the flat textile material and/or there is a risk that the adhesion promoting component will be released from the textile surface during its use.

In the case of orthotics and supporting bandages as well as phlebological socks (compression socks), it is advisable and expedient for the product not to slip when worn on the body surface of the patient or user in order to achieve or maintain the desired supporting effect or compression effect. To hold the textile in the proper position on the body for that function, adhesive elements, which impart an increased friction to the bandage on the body surface, may be formed separately on the inside of its textile base body facing the body surface, in particular the skin surface. A known measure here is to provide the inside of the base body with adhesion promoting elastomer material in at least some areas. With this compression sock in particular, the upper band is designed as a so-called adhesive border. It is known that an adhesion promoting material can be applied there.

It is also known that adhesion to surfaces of textile materials can be increased by subsequent spraying or pouring of an elastomer precursor material onto the surface of the finished flat textile material, wherein the precursor material binds superficially to the flat textile material and cures to form the adhesion promoting elastomer. Elastomer materials that adhere especially well to the body surface, in particular the skin surface, include silicone elastomers (silicone rubber), polyurethane-based elastomers and chloroprene rubbers and the like. The strength of the adhesive effect may however also be controlled by the size and position of the applied adhesion promoting surface.

One disadvantage of this concept is that the adhesion promoting elastomer material must be applied to the flat textile material in a certain material thickness in order to have the mechanical stability required for regular use. Therefore, the bandage bulges outward toward the inside in these locations, which is perceived as annoying in the best case, but in the worst case can lead to skin irritation or disturbances in the microcirculation of the skin or even to phlebological complications. This reduces the effective wear time and thus the medical effect of an otherwise expedient medical bandage. In addition, due to the application of material to the textile surface, this leads to the problem that the elastic properties of the bandage are altered in those locations where the elastomer material has been applied and in particular there is a reduced elasticity and reduced flexibility in those locations. This reduces the medical efficacy and usability of such bandages. In particular, it might be expedient to provide adhesion promoting surfaces precisely in those areas of the bandage where the mechanical contact with the body is particularly intense, for example, in the area of and on joint protrusions. However, it is precisely in these areas, where the thickening of the material and the reduced elasticity and flexibility due to this application of an elastomer material are perceived as particularly annoying and have a negative effect on the bandage itself.

The technical problem on which the present invention was based was to overcome the known disadvantages of adhesion promoting nonslip components applied post-production to flat textile materials.

To solve this problem, the invention makes available a flat textile material, i.e., a textile, in particular a knit or crocheted material, a woven fabric or a fiber pile, i.e., a nonwoven, in particular a mesh material, wherein the adhesion promoting component is present as an integral part of the textile itself.

The flat textile material is preferably a knit, in particular a tricot knit, and the adhesive thread according to the invention may form a part of the weave. The type of weave of the knit is preferably selected from closed fringe, open fringe, closed tricot weave and open tricot weave, as well as combinations derived from these.

In another embodiment, the flat textile material is a crocheted material. The adhesive thread according to the invention is in particular a stitch-forming thread. The weave is preferably selected from right/right plain weave, left/left plain weave, right/left plain weave and right/right/crossed plain weave as well as combinations derived from these.

In an alternative embodiment, the flat textile material is a woven fabric, in which the adhesive thread according to the invention is present preferably exclusively as a warp thread. Preferred weaves are selected from linen weave, twill weave and satin weave and combinations derived from these.

In an alternative embodiment, the flat textile material is a fiber pile or a nonwoven.

Therefore, the invention provides in particular that at least a portion of the stitch-forming threads in the textile itself have a surface with an adhesive effect. Therefore the subject matter of the invention is a textile having an adhesive effect, containing at least one mesh or loop-forming adhesive thread, wherein the adhesive thread has at least one adhesion promoting component, preferably a textile, which is a crocheted material or knit fabric, a woven or nonwoven fabric, at least on its surface, wherein the adhesive thread is embodied as a mesh and/or as a loop and runs in at least some sections at the surface of the flat textile material in order to form an adhesive surface on the textile itself there. This so-called adhesive thread is especially a stitch-forming thread of the textile. Alternatively, the adhesive thread forms loops in the textile. It is preferably ruled out that this adhesive thread is present additionally or even exclusively as a weft thread in the textile.

According to the invention, the flat textile material is thus furnished directly itself with an adhesive surface or with surface sections formed by the adhesive thread in the textile. By means of suitable techniques which are known per se in the production of the textile, in particular the knit or crocheted material, the woven or nonwoven fabric, the mesh and/or loop-forming adhesive thread runs at the surface of the textile in at least some sections.

In a special embodiment, the only means imparting adhesion to the surface is provided at the surface of the adhesive thread according to the invention. An additional application of a separate adhesion promoting material such as an elastomer that is known per se is preferably precluded here.

It is preferably provided that the textile having an adhesive effect exhibits this adhesive effect, which is imparted by the adhesive thread designed according to the invention, only within one or more adhesive zones or the effect is especially pronounced there.

It is preferably also provided that the textile material having the adhesive effect exhibits this effect in several peripheral rows of stitches due to the adhesive effect imparted by the adhesive thread designed according to the invention or this effect is especially pronounced there.

The adhesive thread, in particular in such an adhesive zone of the textile fabric or in peripheral rows of stitches is preferably arranged in the directly adjacent parallel rows of stitches in order to impart an intense adhesive effect there. Due to the masking of the adhesive effect of the threads according to the invention before and during the machine processing, this is not subject to any particular restrictions, and the adhesive thread may also be used advantageously in rows of stitches that are directly adjacent. Therefore, preferably at least two adhesive threads are arranged in directly adjacent parallel rows of stitches. Deletions of one, two or more neighboring rows of stitches, in which no adhesive thread according to the invention is arranged, are especially preferably ruled out, at least in an adhesive zone of the textile or peripherally. Adhesive threads preferably run directly adjacent to one another and without omitting one row of stitches in at least 5 or 10 or 20 or 50 or 100 or 200 or 500 or more parallel rows of stitches.

The adhesion promoting component of the adhesive thread in the textile is selected from essentially known adhesion promoting components, especially elastomers and self-stick adhesives. The adhesion promoting component is preferably selected from silicone elastomers, polyurethane elastomers and chloroprene elastomers, with silicone elastomer being particularly preferred, in particular condensation-crosslinking RTV silicone.

To overcome the difficulties in processing an adhesive thread having an adhesive surface as a stitch-forming thread or as a loop in a textile, the invention provides that the adhesive effect of the adhesive thread may be masked before processing, i.e., before production of the textile. It is provided in particular that the masking may be designed to be reversible, so that even after production or completion of the textile, the masking may be removed from the adhesive thread, which is then formed as a stitch. This takes place preferably by means of simple and essentially known measures, such as washing or cleaning the textile prior to use, so that the adhesive thread is demasked and the adhesive effect of the adhesion promoting component can then be manifested in the textile. If the masking is soluble in solvents, in particular water, then it can be washed in the solvent, in particular in water, for the demasking.

Without limiting this to the theory, the term "dissolving" is used not only to describe the physical and/or chemical process of "bringing into solution," but also other dissolving processes, which break up the integrity of the masking and can release the mask from the surface of the adhesive yarn. Therefore, this may include enzymatic cleavage or other types of chemical cleavage or decomposition in particular may be included here.

The solvent is preferably water, especially in mixture with additives that support the washing or dissolving effect, selected from water-soluble organic solvents, in particular ethanol or acetone, detergent, surfactants, washing alkalis, enzymes and mixtures thereof.

Accordingly, the subject matter of the invention is also a method for producing a textile having an adhesive effect with at least the following steps: In step a), an adhesive thread containing an adhesion promoting component, at least at its surface, is supplied. In step b), the adhesive effect of the adhesive thread is reversibly masked. In step c), the adhesive thread is formed as a stitch-forming thread or as a loop, which now has a masked adhesive effect in or on a textile, preferably being produced by machine.

It is preferably provided in step b) that at least one so-called masking layer is applied to the adhesive thread, essentially completely covering the adhesive surface of the adhesive thread.

To permit reversible masking, the invention preferably provides that the masking layer intended for this purpose is to be formed from a material that is itself easily removed. The masking layer therefore contains or consists of at least one material that can be dissolved by the action of solvents and/or solvent vapor, in particular a polymer.

The soluble material is preferably water-soluble, in particular preferably water-soluble, polyvinyl alcohol (PVOH). Alternative soluble polymers include polyacetate, polylacetate, polypropylene sulfide, protein-based polymers, casein, starch-based polymers, cellulose as well as other soluble or enzymatically or chemically cleavable polymers.

In a first variant, the soluble material is supplied as a liquid masking solution or suspension which forms a masking coating after curing on the adhesive thread. Alternatively, the soluble material is spun to form a fiber or a filament and the adhesive thread is covered with it, i.e., sheathed with it, in particular being wrapped with it or having that thread spun out it.

In a preferred variant, the masking layer is formed by forming a coating on the adhesive thread. Therefore, in a substep b1) of step b), a liquid masking solution or suspension is supplied and is brought in contact with the adhesive thread in substep b2), and then the solution or suspension is cured to form the masking layer on the adhesive thread.

In an alternative variant, the masking layer is formed by a sheathing thread. In this variant in step b) in a substep b1) a masking thread or masking filament is supplied and then used to cover, i.e., to sheath, the adhesive thread in substep b2), in particular by wrapping or spinning the masking thread around the adhesive thread to form a masking layer.

To obtain the textile end product with a surface that adheres in at least some sections, the method according to the invention proposes that the adhesion promoting component on the adhesive threads in the textile shall be demasked, wherein the threads are then in the form of stitches or loops, by removing the masking layer on the adhesive threads. If a soluble material is used as the masking layer, as is preferred, then the demasking can take place by simply washing or cleaning the textile in solvent and/or treating with a solution vapor. One attractive feature here in particular is that textiles are usually treated in a washing or cleaning step anyway after machine production in order to remove the fiber residues and dust that are always generated during machine production in particular. In this way, the result immediately after the end of the washing or cleaning step—and thus after the inventive demasking of the adhesive effect—is a textile material, which has a surface with an adhesive effect in at least some sections.

The subject matter of the invention is also a textile with an adhesive effect, which can be adjusted according to the method described in greater detail above.

The textiles with the adhesive effect and/or the textiles having an adhesive effect that can be obtained according to the invention can be used in particular with textile products, in which a secure and immovable positioning on the body of the wearer is advisable and expedient, and in order to enable or maintain the intended effect, in particular the medical effect of the textile product. Accordingly, one subject matter of the invention is thus also a bandage, an orthopedic bandage or an athletic bandage which has a nonslip effect and which the textile according to the invention contains or consists of. Finally, one subject matter of the invention is also socks with a compression effect, support hose, athletic socks, in particular compression socks or phlebological socks, which the textile according to the invention contains or consists of.

The invention is described in greater detail by the following exemplary embodiment, without considering this to be restrictive.

FIG. 1 shows a detail of a mesh material, in particular for use as a base body of a bandage containing a knitting thread 10 and another stitch-forming knitting thread 20. Elastic rubber threads 30 are inserted into the woven fabric. According to the invention, the stitch-forming thread 20 has a tacky adhesive surface, which is exposed after knitting the thread 20 by washing off the mask in the finished mesh material. The stitch-forming thread 20 with an adhesive surface runs at the surface of the mesh material in at least some sections, where it imparts a nonslip effect.

The invention claimed is:

1. A method for producing a textile with an adhesive effect, the method comprising:

a) supplying an adhesive thread having a surface comprising an adhesion promoting component having an adhesive effect;

b) reversibly masking the adhesive effect of the adhesion promoting component of the adhesive thread by:

b1) supplying a masking solution or a masking suspension; and b2) contacting the surface of the adhesive thread with the masking solution or masking suspension comprising a polymer that is soluble in a solvent or in a solvent vapor and curing the masking solution or masking suspension to form a masking layer comprising the polymer, the masking layer partially or completely covering the adhesive thread to generate a masked adhesive thread comprising the masking layer;

c) forming the masked adhesive thread as a stitch-forming thread or a loop in a textile material; and d) demasking the adhesion promoting component by removing the masking layer from the masked adhesive thread.

2. The method according to claim 1, wherein the removing the masking from the masked adhesive thread comprises washing the textile material in a solvent and/or treating the textile material with a solvent vapor.

3. A textile with an adhesive effect produced by the method according to claim 1.

4. A sock or textile with an adhesive effect, the sock or textile comprising at least one stitch-forming adhesive thread having:

a surface comprising an adhesive promoting component that imparts an adhesive effect; and a removable masking layer coating a portion or all of the surface, wherein the removable masking layer is generated by:

contacting the at least one stitch-forming adhesive thread with a masking solution or a masking suspension; and curing the masking solution or masking suspension on the surface.

5. The sock or textile according to claim 4, wherein the adhesion promoting component is an elastomer or a self-stick adhesive.

6. The sock or textile according to claim 4, which is formed as a knitted or a crocheted material fabric, wherein the at least one stitch-forming adhesive thread is embodied as a mesh and runs at a surface of the knitted or crocheted material fabric in at least some sections to form an adhesive surface on the sock or textile.

7. The sock or textile according to claim 4, which is a woven or a nonwoven fabric, wherein the at least one stitch-forming adhesive thread is designed as a loop and runs at a surface of the sock or textile in at least some sections to form an adhesive surface on the sock or textile.

8. A method for producing a textile with an adhesive effect, the method comprising:

forming a masked adhesive thread into a textile material, the masked adhesive thread comprising an adhesive thread having an adhesive surface and a removable masking layer coating the adhesive surface of the adhesive thread and masking the adhesive surface, wherein the masked adhesive thread is formed by:

contacting an adhesive thread with a masking liquid comprising a water-soluble polymer; and curing the masking liquid to form the masked adhesive thread.

9. The method according to claim 8, wherein the water-soluble polymer comprises polyvinyl alcohol, polyacetate, polylacetate, or polypropylene sulfide.

10. The method according to claim 8, wherein the water-soluble polymer comprises casein, starch, or cellulose.

11. The method according to claim 8, wherein the removable masking layer coats a portion of the adhesive surface.

12. The method according to claim 8, wherein the removable masking layer completely coats the adhesive surface.

13. The method according to claim 8, wherein the adhesive surface comprises a silicone elastomer, a polyurethane elastomer, or a chloroprene elastomer.

14. The method according to claim 8, wherein the forming comprises knitting, crocheting, or weaving the masked adhesive thread into the textile material.

15. The method according to claim 8, further comprising:

forming the textile material into a sock.

16. The method according to claim 8, further comprising:

removing the removable masking layer by washing the textile material in water; and exposing the adhesive surface of the adhesive thread.

* * * * *